US005722566A

United States Patent [19]

Glynn

[11] Patent Number: 5,722,566

[45] Date of Patent: Mar. 3, 1998

[54] DOUBLE ACTION WATER GUN

[75] Inventor: Kenneth P. Glynn, Raritan Township, Hunterdon County, N.J.

[73] Assignee: Ideal Ideas, Inc., Flemington, N.J.

[21] Appl. No.: 613,476

[22] Filed: Mar. 11, 1996

[51] Int. Cl.[6] ..... A63H 3/18

[52] U.S. Cl. ..... 222/79; 222/318

[58] Field of Search ..... 222/79, 324, 404, 222/383.1, 341, 318, 375

[56] References Cited

U.S. PATENT DOCUMENTS 3,197,070 7/1965 Pearl et al. ..... 222/79
4,503,996 3/1985 Sorm et al. .
4,646,969 3/1987 Sorm et al. .
5,244,153 9/1993 Kun et al. ..... 222/79
5,465,880 11/1995 Glynn .

*Primary Examiner*—Philippe Derakshani
*Attorney, Agent, or Firm*—Kenneth P. Glynn

[57] ABSTRACT

The present invention is a continuous action toy water gun for spraying liquid material. It includes a main housing having an operation cylinder, a liquid chamber and a handle. It also includes a pumping element which is within the operation cylinder and has a valve seat, a one-way valve and a pumping rod, which permits liquid material to pass therethrough in a relative direction toward a spray nozzle, but not toward the liquid chamber. There is a relief valve having a seat with an opening therethrough and a relief passage to bleed liquid back to a dip tube extending into a water bomb and which cooperates with the pumping element. There is also a moving means for moving the pumping element.

20 Claims, 4 Drawing Sheets

DOUBLE ACTION WATER GUN

BACKGROUND OF THE INVENTION

1. Field of the Invention

The present invention involves toy water guns which rely upon trigger and slider action by a user for spraying water. More particularly, the present invention relates to a double action water gun, i.e., one which sprays water both when the trigger or slider moves forward and when the trigger or slider moves in reverse.

2. Information Disclosure Statement

Various double action sprayers have been developed over the years and The Academy of Sciences of Czechoslovakia developed a double action liquid atomizer and a double action trigger sprayer liquid atomizer. However, these sprayers are non analogous art. Also, there is an issued patent by the same inventor herein for a double action spray dispenser. These are described in the patent literature as follows:

U.S. Pat. No. 4,503,996 issued to Miloslav Sorm et al. describes a liquid atomizer having a reciprocable pump. The atomizer provides a reliable sealing of the piston rod of the pump with lowered requirements as to the manufacturing tolerances of parts, a simplified manner of venting, and the sealing of the atomizer against leakage when the atomizer is placed in any arbitrary rest position. A sleeve having a smaller inner diameter than the cylinder is mounted on the upper part of the cylinder of the pump and its upper part is in contact with the inner part of a neck of a housing for the atomizer. A free space between the inner wall of the housing and the outer wall of the cylinder of the pump is connected below with the interior of the bottle on which the atomizer is mounted, and the upper part of the free space communicates with the surface of a tube by radial channels passing through the sleeve of the cylinder. The tube which slidingly passes through the neck of the housing, is connected on the top with an operating button, and ends below with a sealing cuff piston which covers, when in its upper position, the radial channels and, at the same time, bears by its upper part on the neck of the housing. The tube forms a part of a narrow upper part of a piston rod which reciprocates through the sleeve, whereas the lower broadened part of the piston rod bears the piston of the pump and a one-way valve.

U.S. Pat. No. 4,646,969 issued to Miloslav Sorm et al. describes a double-acting mechanical liquid spraying device having a housing which is adapted to be mounted upon and sealed to the neck of a liquid container, and which has a liquid-containing compartment therein. In the housing, aligned with the liquid-containing compartment, there is an operation cylinder which has an annular valve seat disposed transversely to an intermediate the length of such cylinder. Disposed within the liquid-containing compartment is a liquid pumping plunger of the cuff type which cooperates with the valve seat to close the opening through such seat when the plunger is in its forward terminal position, and which is driven to reciprocate within the liquid-containing compartment in forward and reverse liquid dispensing strokes. In each of such strokes the plunger forwards liquid from the liquid-containing compartment to a spray nozzle through a liquid-conducting passage. Interposed in the liquid-conducting passage between the plunger and the spray nozzle are a relief valve and a relief passage which bleed liquid back to the liquid container and allow atmospheric air to be drawn in through the spray nozzle at the end of the reverse stroke of the plunger, thereby to clear the spray nozzle of liquid at the end of each pumping cycle consisting of a forward and a reverse stroke. As a consequence, fast-drying liquids can be sprayed with the device of the invention.

U.S. Pat. No. 5,465,880 to Glynn, who is the same inventor herein, describes a continuous action spray dispenser for spraying liquid material therefrom. This patent discloses a similar pumping element to the present invention. However, the patent issued less than one year prior to the filing date of this application.

Notwithstanding the above prior art, there are no teachings or suggestions that would render the present invention anticipated or obvious. One skilled in the art of toy guns would not look to the art of liquid sprayers in designing toy guns.

Moreover, the Czech double action sprays and liquid dispensers rely upon a cuff type piston and valve and this cuff acts as a valve by being spread open on the forward stroke so as to prevent passage of liquid past it and squeezed closed on the reverse stroke so as to permit liquid to pass by it. However, this cuff acts as a valve with its seat being essentially the side walls of the chamber. In other words, the cuff and chamber walls move relative to one another and this abrasion causes leakage, unusual wear and sometimes volume problems. Thus, the present invention is directed to overcoming these shortcomings of the aforesaid prior art.

SUMMARY OF THE INVENTION

The present invention is a continuous action toy water gun for spraying liquid material, such as water. It includes a main housing having an operation cylinder, a liquid chamber and a handle having a tube extending therethrough. It also includes a pumping element which is located within the operation cylinder so as to be horizontally reciprocally movable therein. The pumping element has a predetermined shape, volume and displacement with a first, forward position and a second, rearward position and includes a valve seat, a one-way valve and a pumping rod located on a forward position of the pumping element, which permits liquid material to pass therethrough in a relative direction toward a spray nozzle, but not toward the liquid chamber. There is also a relief valve having a seat with an opening therethrough and a relief passage to bleed liquid back to the tube in the handle to allow atmospheric air to be drawn in through the spray nozzle at the end of the reverse movement of the pumping element causing the spray nozzle to be cleared of liquid. There is a moving means for moving the pumping element, which has a first position and a second position corresponding to the pumping element first position and second position. There is also a dip tube extending from the tube in the handle to a water bomb which is attached to the top of the water gun.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
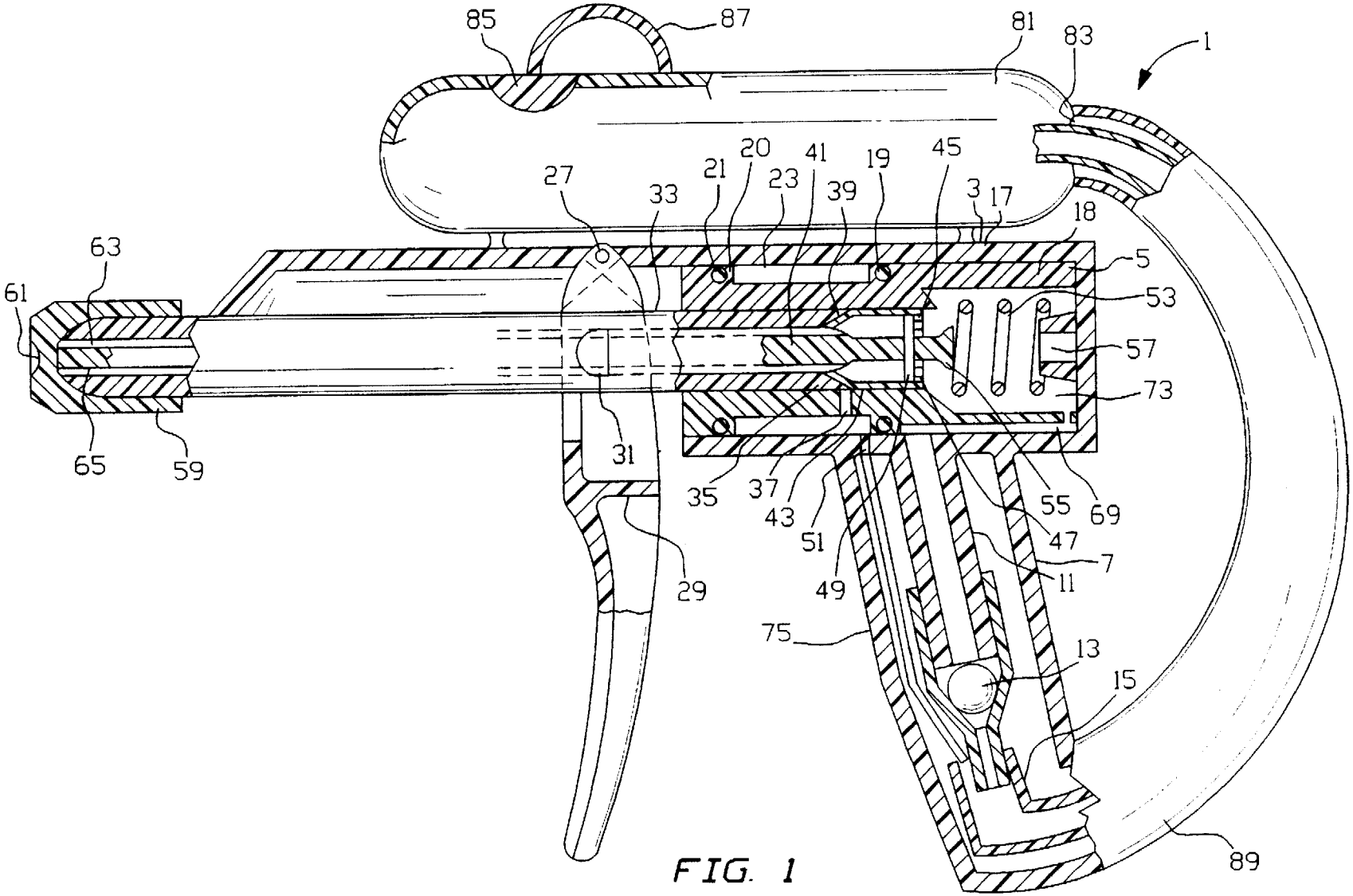
FIG. 1 shows a fragmentary view partially in side elevation and partially in vertical axial section of a preferred embodiment of a continuous acting toy water gun having a trigger for causing fluid to spray.

The present invention is a continuous action toy water gun which is used for spraying water. The toy water gun is comprised of the following components:

(a) A main housing, which has an operation cylinder aligned with a liquid chamber, and a handle having a tube extending therethrough.

(b) A pumping element, which is at least partially located within the operation cylinder so as to be horizontally reciprocally movable therein. The pumping element has a predetermined shape, volume and displacement and has a first position and a second position within the liquid chamber. The first position results from forward movement and establishes a minimum portion of volume of said pumping element within said liquid chamber, and permits a predetermined maximum available volume for liquid material within the liquid chamber. The second position results from rearward movement and establishes a maximum portion of volume of the pumping element within said liquid chamber, and permits a predetermined minimum available volume within the liquid chamber for liquid material due to volume displacement by the pumping element.

The pumping element includes thereon a valve seat, one way valve and pumping rod. The one way valve may be a flap valve, a spider valve or a ball valve. The valve seat, one way valve and pumping rod move together with the pumping element when the pumping element is moved. The one way valve, which is located on a rearward portion of the pumping element, permits liquid material to pass therethrough in a relative direction toward a spray nozzle, but not toward the liquid chamber and does not contact the wall of the operation chamber. The pumping rod is located on a forward portion of the pumping element opposite the location of the seat and one way valve.

(c) A piston, which has the pumping element mounted therein and which is connected to a moving means for moving the pumping element for reciprocal movement. The moving means has a first position and a second position corresponding to the pumping element first and second positions.

There is also an optional relief valve which moves with the piston and which has a seat with an opening therethrough and a relief passage. The relief passage bleeds liquid back to the tube in the handle and allows atmospheric air to be drawn in through the spray nozzle at the end of the reverse movement of the pumping element causing the spray nozzle to be cleared of liquid. The relief valve seat cooperates with the pumping element to close the opening through the seat when the pumping element is in its forward position.

(d) A dip tube connected to the lower end of the tube in the handle of the housing and which extends into a water bomb located on the top of the toy water gun.

(e) A spring mechanism, which is cooperatively located between the pumping element and the rear of the main housing and biasing the moving means and pumping element to their first position.

When the moving means is reciprocated to prime and when the moving means and therefore the pumping element is then moved from the first position to the second position, the liquid material in the liquid chamber from a preceding cycle then passes through the pumping element one way valve and seat and at least a portion thereof exits through a liquid conduction means and the spray nozzle.

When the moving means and therefore the pumping element is then returned from the second position to the first position via return of said spring mechanism, the liquid material in the water bomb is sucked into the liquid chamber and liquid material in the area forward the closed valve exits through the liquid conduction means and the spray nozzle. By repeated forward and reverse strokes of the moving means, a continuous action spray is created.

Referring now to FIG. 1, a continuous action toy water gun 1 has a main housing 3 having an axially extending circular cylindrical bore 5 therewithin. A tube 11 located in a handle portion 89 of the main housing 3 has a check valve 13 mounted on the lower end thereof, the lower end of the tubular outer member of the check valve 13 being connected to the upper end of a dip tube 15 which leads in an approximate semi-circle to the interior of a water bomb 81. The check valve 13 permits the passage of liquid from the water bomb 81 to within the tube 11, but prevents the return of such liquid to the dip tube 15.

The water bomb 81 is attached to the top of said main housing 3 and includes an aperture 83 for the dip tube 15 and a water-fill aperture (shown with a cap 85) which is sized and shaped to fit a stream of water from a water source. The cap 85 plugs the water-fill aperture and prevents water from flowing out of the water bomb 81 after the water bomb 81 has been filled. The cap 85 has a stem 87 extending therefrom and which is attached to the top of the water bomb 81 on the other end.

The dip tube 15 is surrounded by a conduit 87 in the part of the dip tube 15 extending from the base of the handle 89 to the aperture 83 in the water bomb 81. The conduit 89 in this embodiment is an arcuate shape, but the conduit could also be angled. The conduit 89 has means for attachment to the water bomb 81 and the handle 89. The means may be a crimp seal, glue or the like.

An operation cylinder 17 is mounted within the bore of the main housing 3 coaxially thereof and is sealed thereto by a rear O-ring 19 and a forward O-ring 21. After assembly of such parts, the operation cylinder 17 has a first, rear, circular cylindrical bore 18 therewithin, and a second, front, smaller diametered bore 20 therein, such bores being coaxial. The junction between the bores 18 and 20 is in the form of a rearwardly converging frusto-conical or annular wedged-shaped surface. Between the forward O-ring 21 and the rearward O-ring 19, the forward portion of the operation cylinder 17 is provided with an elongated annular recess, such recess forming an annular cavity 23 with the confronting portion of the wall of the bore 5 in the main housing 3.

The housing 3 is provided with a pivot pin 27 to which the upper end of a control trigger or handle 29 is pivotally connected. An intermediate portion of the trigger 29 is pivotally connected by oppositely directed pivot means, one of which is shown at 31, to a piston 33 in the form of an elongated sleeve.

The piston 33 has the rear end thereof slidably mounted within the bore 20 of the operation cylinder 17. The piston 33 has a diameter of from approximately 0.05 to 0.20 mm less that the diameter of the bore 20. The inner or rear end of the piston 33 is made in the form of a cuff piston 35 opening to the rear which sealingly cooperates with the bore 20 and which functions as the movable element of a valve which selectively opens and closes a liquid bleeding hole or opening 37 in the forward portion of the operation cylinder 17.

Within the tubular piston 33, there is mounted a pumping element 39 which includes a rod 41, a valve support 43 having a plurality of inlets such as 45 and 47, and a washer-type valve 49 and is attached to a narrower or constricted portion of the pumping element 39. The pumping element 39 and consequently the washer-type valve 49 are constantly urged forwardly, that is to the left, by a coil compression spring 53 which acts between a spring seat 55 on the rear of the pumping element 39 and a spring seat 57 on the rear of the main housing 3 of the double action toy water gun 1.

Although this embodiment shows a washer type valve, alternatively, a one-way flap valve, a spider valve or a ball valve could also be employed.

As can be seen, the pumping element 39 has a predetermined shape, volume and displacement. When the pumping element 39 is urged to its forward position, the pumping element 39 is in its first position. By pushing the trigger 29, the pumping element 39 is moved to it rearward position and pumping element 39 is in its second position.

A spraying nozzle 59 is provided on the outer left-hand end of the toy water gun 1. With the parts in the positions thereof shown in FIG. 1, the left-hand end surfaces of the pumping element 39 and the tubular piston 33 lie in a common transverse plane. The spraying nozzle 59 includes an annular member having a circular cylindrical tubular portion telescoped over the outer end of the tubular piston 33 and a frusto-conical portion converging to the left, as shown. A central axially directed spray aperture 61 is formed in the end portion of the spraying nozzle 59.

Liquid under pressure is fed to the interior of the nozzle 59 and thence outwardly through the spray aperture 61 by means of at least one axially extending groove 63, 65 in the outer surface of the pumping element 39. Such liquid under pressure is supplied to the grooves 63, 65 and thence to the spray nozzle 59 by the action of the pumping element 39 when the pumping element 39 moves to its forward position under the thrust exerted upon it by the coil compression spring 53 and by the cuff 35 of the piston 33 when the piston 33 is thrust to the rear by the counter-clockwise swinging of the trigger 29 acting through the pivot means 31.

Upon the forward stroke of the pumping element 39, liquid is sucked from the water bomb 81 through the dip tube 15 to the check valve 13, upwardly into the tube 11 through a passage 69 formed as a groove in the portion 18 of the cylinder 17. Liquid thus fills a liquid chamber 73, which is the area surrounding the spring 53. It is this body of liquid which is dispensed in both the oppositely directed strokes of the toy water gun 1 as the trigger 29 is oscillated.

The pumping element 39 and the piston 33 move together as a unit with a small endwise play between them to the rear when the trigger 29 is oscillated counterclockwise, since the left hand end of the pumping element 39 is engaged by the inner surface of the spray nozzle 59, whereby in the initial part of such rearward stroke, the cuff piston 35 soon travels to and seals the radial opening 37 in the wall of portion 20 of operation cylinder 17, thus permitting the liquid to be transmitted through the grooves 63, 65 to the spraying nozzle 39 under pressure.

When the trigger 29 is released and the coil spring 53 thrusts the pumping element 39 to the left, the pumping element 39 thrusts the liquid in the area forward the closed valve 49 to the left under pressure through the grooves 63, 65 to the spray nozzle 39. Such discharge under pressure continues until the tubular piston 33 moves to the left sufficiently for the sealing cuff 35 thereon to uncover the radial opening 37 so that the remainder of the liquid, which would otherwise be forwarded to the spray nozzle 39, is now bled through the radial opening 37 in the main housing 3 which drains the liquid in space 23 downwardly into an opening 51 and into a passage 75 which leads the liquid back into the dip tube 15.

In operation, the spring 53 presses the pumping element 39 to the left into the rest position thereof shown in FIG. 1. The pumping element 39 and thus also the longitudinal grooves 63, 65 and the spray nozzle 59 are connected with the liquid sucked from the water bomb 81 through the transverse channels 73, 23. Assuming that the liquid chamber 73 and all space extending therefrom to the check valve 13 are filled with liquid from a preceding operation, the liquid starts to flow by pushing the trigger 29 in a counter-clockwise direction, that is to the right, to thrust the pumping element 39 into the space located where the spring is in a depressed position. The one way valve 49 moves forward and the liquid is able to pass through the inlets 45, 47. For a first short moment, the liquid then flows through the longitudinal channels 63, 65, the opening 37 and the transverse channels 23, 51, 75 back into the dip tube 15.

After the valve made of the cuff 35 on the piston 33 and the opening 37 closes, that is after the cuff 35 covers the passage 37, all of the liquid now flows to the left through the longitudinal grooves 63, 65 toward the spray nozzle 59. Air is sucked into the water bomb 81 through the clearance between the piston 33 and the bore 20 and entrains a contingent leaking liquid through the opening 37 and the transverse channels 23, 51, 75 back into the dip tube 15.

If the control trigger is then released, the spring 53 pushes the pumping element 39 forward, that is to the left, and the one way valve 49 is forced down and seals off the inlets 45, 47 and no liquid is allowed to pass therethrough. However, the liquid is forced out from the portion of the pumping element forward the closed one way valve, that is the portion to the left. The liquid passes through the longitudinal channels 63, 65 into the spraying nozzle 59. By the repeated pushing and releasing of the trigger 29, a virtually continuous cloud of sprayed liquid is formed.

During the operation of the toy water gun 1, there is a liquid seal between the piston 33 and the pumping element 39 which lets enough air into the toy water gun 1 for a reliable operation thereof, but does not allow a fast and complete equalizing of the inner and outer air pressure. After the spray operation has been completed, the control trigger 29 is completely released and a residual under pressure in the water bomb 81 is equalized with the atmospheric pressure through the spraying nozzle 29, whereby the liquid form the spraying nozzle 29 is sucked through the longitudinal grooves 63, 65, the opening 37 and the transverse channels 23, 51, 75 back into the dip tube.

Figure 2:
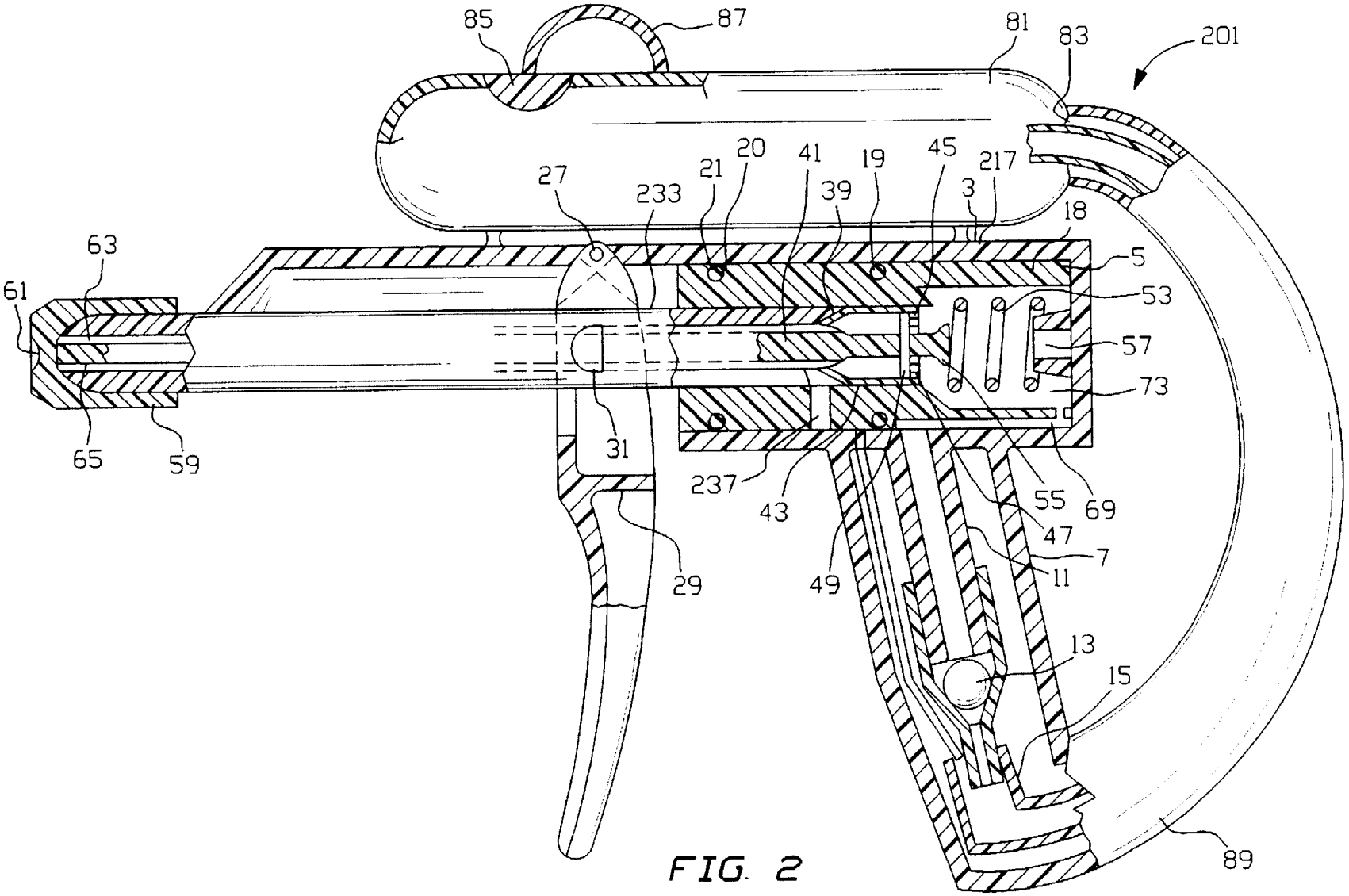
FIG. 2 shows a fragmentary view partially in side elevation and partially in vertical axial section of an alternative embodiment of a continuous acting toy water gun having a trigger for causing fluid to spray.

FIG. 2 shows an alternative embodiment of the present invention. In this embodiment, a toy water gun 201 functions the same as the toy water gun of FIG. 1 with the exception of the bleeding of liquid into the dip pipe with the rearward stroke of the trigger. The piston 233 is a straight piston, not having the cuff opening to the rear. The operation cylinder 217 does not contain an annular recess. Therefore, water does not bleed through to a dip pipe.

Upon the rearward stroke of moving means, in this case a trigger 29, the piston 233 travels to and seals the radial opening 37 in the wall of the operation cylinder 17, thus permitting liquid to be transmitted through the grooves 63, 65 to the spraying nozzle 39 under pressure.

When the trigger 29 is released and the coil spring 53 thrusts the pumping element 39 to the left, the pumping element 39 thrusts the liquid in the area forward the closed valve 49 to the left under pressure through the grooves 63, 65 to the spray nozzle 39. Such discharge under pressure continues until the remainder of the liquid is forwarded to the spray nozzle 39.

Figure 3:
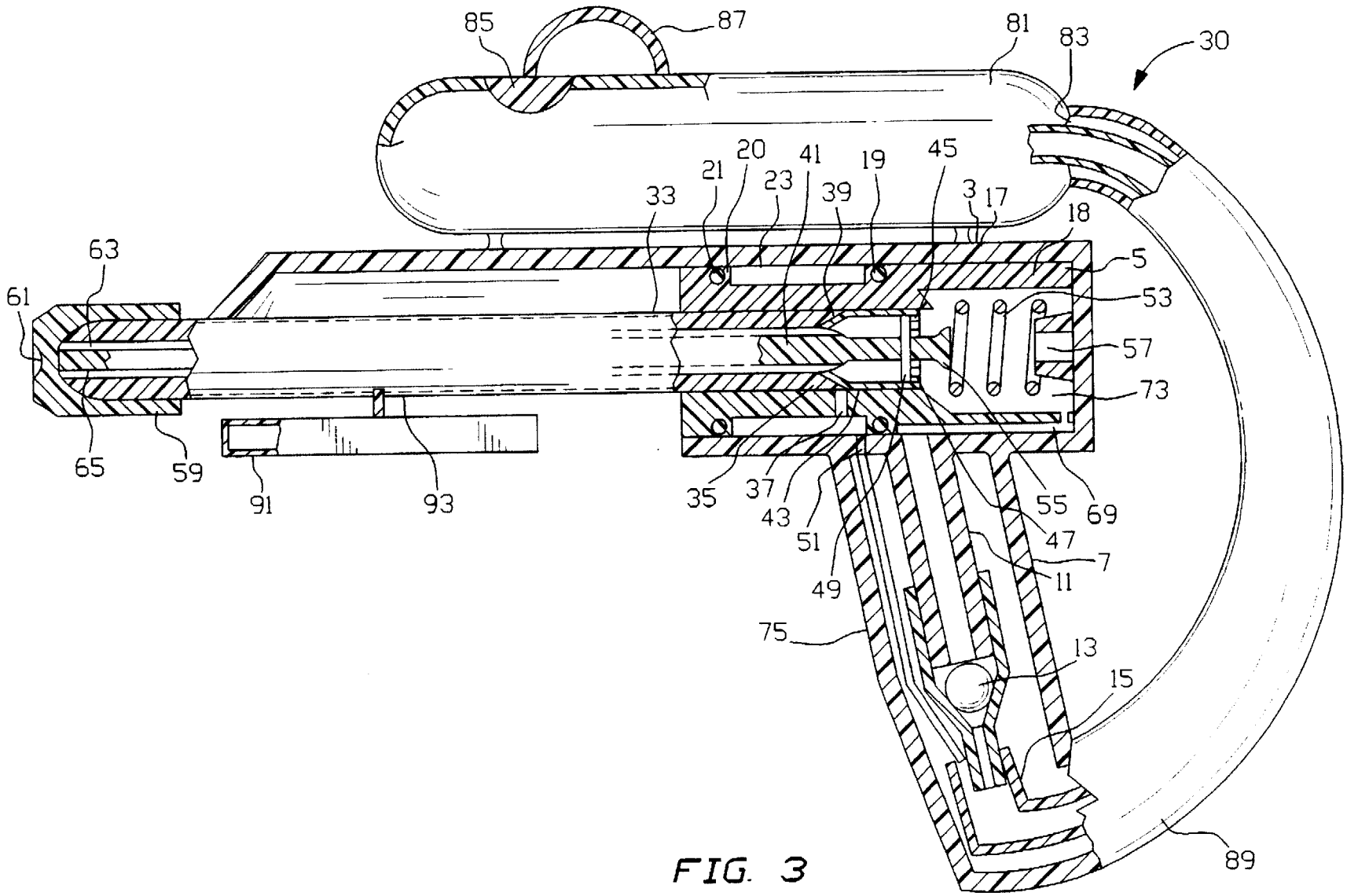
FIG. 3 shows a fragmentary view partially in side elevation and partially in vertical axial section of a preferred embodiment of a continuous acting toy water gun having a slider for causing fluid to spray.

FIG. 3 shows an alternative embodiment of the present invention and many of the parts are identical to those shown in FIG. 1 and are identically numbered. In this embodiment, the toy water gun 301 includes a slider 91 for causing the pumping element 39 to move forward or rearward instead of the trigger 29 of FIG. 1. In all other respects, the operation of the toy water gun 1 in this embodiment is the same as the operation of the toy water gun 1 described by FIG. 1.

The slider 91 is attached to the piston 33 through an aperture 93 in the forward bottom of the main housing 3. The pumping element 39 and therefore the slider 91 are urged to their forward or first position by the action of the coil spring 53. When the slider 91 is moved rearward, slider 91 and therefore the pumping element are moved to their rearward or second position.

Figure 4:
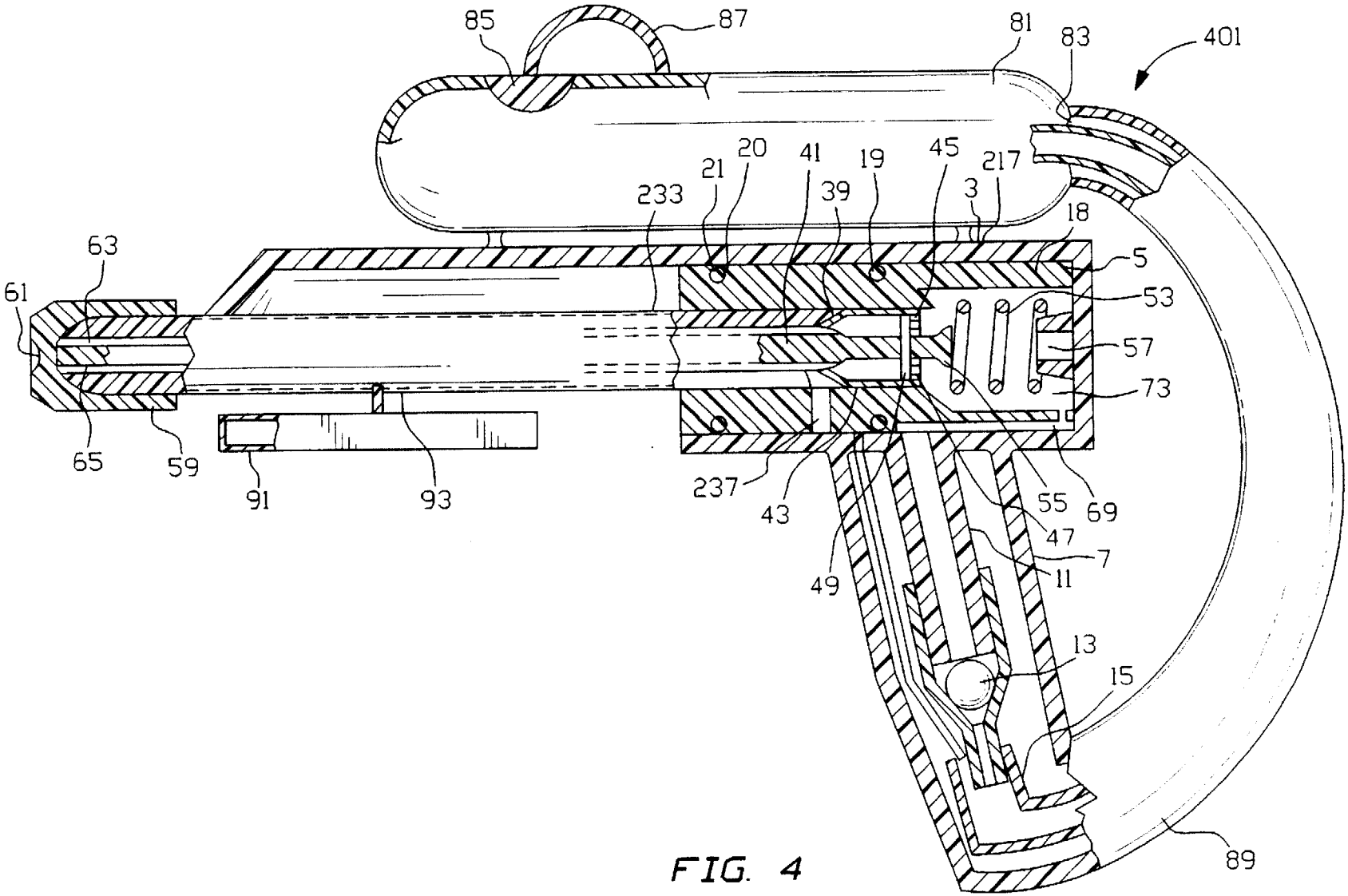
FIG. 4 shows a fragmentary view partially in side elevation and partially in vertical axial section of an alternative embodiment of a continuous acting toy water gun having a slide for causing fluid to spray.

FIG. 4 shows another alternative embodiment of the present invention. In this embodiment, a toy water gun 401 includes a piston 233 as described in FIG. 4 with a slider 91 for the moving means, as described in FIG. 3.

It should now be seen that the present invention double action toy water gun has an enhanced arrangement, whereby the valve which moves with the pumping element does not frictionally drag against its seat nor does it 10 move in such a way that it could wear out or fail along side walls as the valve seat moves with the valve and the pumping element in the present invention device.

Obviously, numerous modifications and variations of the present invention are possible in light of the above teachings. For example, many different types of one way valves may be used. It is therefore understood that within the scope of the appended claims, the invention may be practiced otherwise than as specifically described herein.

What is claimed is:

1. A continuous action toy water gun, which comprises:

a) a housing having a liquid chamber located within an operation cylinder, and a handle having a tube extending therethrough;

b) a pumping element located in said operation cylinder and being driven to reciprocate in horizontal forward and rearward strokes to dispense liquid from said liquid chamber, said pumping element having a predetermined shape, volume and displacement and having a first position and a second position within said operation cylinder, said first position resulting from forward movement and establishing a minimum portion of volume of said pumping element within said liquid chamber and permitting a predetermined maximum available volume within said liquid chamber for liquid material, said second position resulting from rearward movement and establishing a maximum portion of volume of said pumping element within said liquid chamber and permitting a predetermined minimum available volume within said liquid chamber for liquid material due to volume displacement by said pumping element, and said pumping element including thereon a valve seat, a one way valve and a pumping rod such that said valve seat, said one way valve and said pumping rod move together with said pumping element when said pumping element is moved, said one way valve permitting liquid material to pass therethrough in a relative direction toward a spray nozzle, but not toward said liquid chamber, both said valve seat and said one way valve being located on a rearward portion of said pumping element such that said one way valve does not contact the wall of said operation cylinder, said spray nozzle being located on said housing and being connected to a liquid conducting means which allows liquid to flow from said pumping element to said spray nozzle, said pumping rod being located on a forward portion of said pumping element;

c) a relief valve connected to moving means for moving said pumping element and having a seat with an opening therethrough and a relief passage to bleed liquid back to said tube of said handle and to allow atmospheric air to be drawn in through said spray nozzle at the end of the rearward movement of said pumping element whereby said spray nozzle is cleared of liquid, said relief valve seat cooperating with said pumping element to close said opening through said seat when said pumping element is in its forward position, said moving means having a first position and a second position corresponding to said pumping element first position and second position; and (d) a dip tube connected to the lower end of said tube in said handle of said main housing and extending to an inner portion of a water bomb attached to the top of said water gun;

such that when said moving means is reciprocated to prime and when said moving means and therefore said pumping element is moved from said first position to said second position, liquid material passes through said one way valve and seat and at least a portion thereof passes successively through said liquid conducting means and said spray nozzle, and when said trigger and therefore said pumping element is then returned to said first position, liquid material is sucked through said dip tube from said water bomb into said liquid chamber and liquid material in the area forward the closed valve exits through said liquid conduction means and said spray nozzle, thereby creating a continuous action spray on forward and rearward strokes of said pumping element.

2. The continuous action toy water gun of claim 1 further including a spring mechanism biasing said moving means and said pumping element to their first position.

3. The continuous action toy water gun of claim 2 wherein said spring mechanism is a coil spring.

4. The continuous action toy water gun of claim 3 wherein said moving means is a trigger.

5. The continuous action toy water gun of claim 3 wherein said moving means is a slider.

6. The continuous action toy water gun of claim 4 wherein said one way valve and seat is a one way flap valve and seat.

7. The continuous action toy water gun of claim 6 wherein said one way valve and seat is a spider valve and seat.

8. The continuous action toy water gun of claim 7 wherein said one way valve and seat is a ball valve and seat.

9. The continuous action toy water gun of claim 8 wherein said pumping element further includes a valve support attached to a narrower portion of said pumping element.

10. The continuous action toy water gun of claim 9 wherein said valve support has a plurality of inlets.

11. A continuous action toy water gun, which comprises:

a) a housing having a liquid chamber located within an operation cylinder, and a handle having a tube extending therethrough;

b) a pumping element located in said operation cylinder and being driven to reciprocate in horizontal forward and rearward strokes to dispense liquid from said liquid chamber, said pumping element having a predetermined shape, volume and displacement and having a first position and a second position within said operation cylinder, said first position resulting from forward movement and establishing a minimum portion of volume of said pumping element within said liquid chamber and permitting a predetermined maximum available volume within said liquid chamber for liquid material, said second position resulting from rearward movement and establishing a maximum portion of volume of said pumping element within said liquid chamber and permitting a predetermined minimum available volume within said liquid chamber for liquid material due to volume displacement by said pumping element, and said pumping element including thereon a valve seat, a one way valve and a pumping rod such that said valve seat, said one way valve and said pumping rod move together with said pumping element when said pumping element is moved, said one way valve permitting liquid material to pass therethrough in a relative direction toward a spray nozzle, but not toward said liquid chamber, both said valve seat and said one way valve being located on a rearward portion of said pumping element such that said one way valve does not contact the wall of said operation cylinder, said spray nozzle being located on said housing and being connected to a liquid conducting means which allows liquid to flow from said pumping element to said spray nozzle, said pumping rod being located on a forward portion of said pumping element;

c) a piston having said pumping element mounted therein and being connected to moving means for moving said pumping element, said moving means having a first position and a second position corresponding to said pumping element first position and second position; and (d) a dip tube connected to the lower end of said tube in said handle of said main housing and extending to an inner portion of a water bomb attached to the top of said water gun;

such that when said moving means is reciprocated to prime and when said moving means and therefore said pumping element is moved from said first position to said second position, liquid material passes through said one way valve and seat and at least a portion thereof passes successively through said liquid conducting means and said spray nozzle, and when said trigger and therefore said pumping element is then returned to said first position, liquid material is sucked through said dip tube from said water bomb into said liquid chamber and liquid material in the area forward the closed valve exits through said liquid conduction means and said spray nozzle, thereby creating a continuous action spray on forward and rearward strokes of said pumping element.

12. The continuous action toy water gun of claim 11 further including a spring mechanism biasing said moving means and said pumping element to their first position.

13. The continuous action toy water gun of claim 12 wherein said spring mechanism is a coil spring.

14. The continuous action toy water gun of claim 13 wherein said moving means is a trigger.

15. The continuous action toy water gun of claim 13 wherein said moving means is a slider.

16. The continuous action toy water gun of claim 14 wherein said one way valve and seat is a one way flap valve and seat.

17. The continuous action toy water gun of claim 16 wherein said one way valve and seat is a spider valve and seat.

18. The continuous action toy water gun of claim 17 wherein said one way valve and seat is a ball valve and seat.

19. The continuous action toy water gun of claim 18 wherein said pumping element further includes a valve support attached to a narrower portion of said pumping element.

20. The continuous action toy water gun of claim 19 wherein said valve support has a plurality of inlets.

* * * * *